US006175982B1

(12) United States Patent
Cushwa

(10) Patent No.: US 6,175,982 B1
(45) Date of Patent: Jan. 23, 2001

(54) GEARED WHEELCHAIR RAMP

(76) Inventor: Kurt Hale Cushwa, 105 N. Potomac St., Hagerstown, MD (US) 21740

( * ) Notice: Under 35 U.S.C. 154(b), the term of this patent shall be extended for 0 days.

(21) Appl. No.: 09/294,067

(22) Filed: Apr. 14, 1999

(51) Int. Cl.[7] ..... E01D 18/00; B63B 27/14

(52) U.S. Cl. ..... 14/69.5; 14/72.5; 414/139.5

(58) Field of Search ..... 14/69.5, 72.5, 14/71.3, 71.1; 280/304.1, 250.1; 414/139.5; 114/362

(56) References Cited

U.S. PATENT DOCUMENTS

| | | | | |
|---|---|---|---|---|
| 3,823,790 | * | 7/1974 | Richison et al. | 180/6.7 |
| 3,966,022 | * | 6/1976 | Cheney | 187/12 |
| 4,044,850 | * | 8/1977 | Winsor | 180/9.2 |
| 4,987,978 | * | 1/1991 | Jungersen | 280/304.1 |
| 5,065,468 | * | 11/1991 | Sherrod | 14/72.5 |
| 5,269,227 | * | 12/1993 | Warren et al. | 105/29.1 |
| 5,335,741 | * | 8/1994 | Rabinovitz et al. | 180/8.2 |
| 5,363,771 | * | 11/1994 | Warren et al. | 105/29.1 |
| 5,379,866 | * | 1/1995 | Pearce et al. | 280/304.1 |
| 5,401,044 | * | 3/1995 | Galumbeck | 280/304.1 |
| 5,553,548 | * | 9/1996 | Eaton | 104/183 |
| 5,799,756 | * | 9/1998 | Roberts et al. | 280/304.1 |

FOREIGN PATENT DOCUMENTS

| | | | |
|---|---|---|---|
| 3103162A | * | 8/1982 | (DE) . |
| 3316034A | * | 11/1984 | (DE) . |
| 07206324A | * | 8/1995 | (JP) . |

* cited by examiner

*Primary Examiner*—Eileen D. Lillis
*Assistant Examiner*—Raymond W Addie

(57) ABSTRACT

The Geared Wheelchair Ramp is a wheelchair lift system designed to be a substitute for conventional ramps used to allow accessibility between floor levels. The key of the invention is a gearing system that allows the occupant of a modified wheelchair to go up or down moderate level changes under his own power using the same or less effort required for a conventional ramp. The advantage being that the geared wheelchair ramp requires only a small fraction of the space and is less expensive than a conventional ramp.

2 Claims, 6 Drawing Sheets

DETAIL VIEW

DETAIL VIEW

GEARED WHEELCHAIR RAMP

CROSS-REFERENCE TO RELATED APPLICATIONS

No cross-references are noted.

STATEMENT REGARDING FEDERALLY SPONSORED RESEARCH OR DEVELOPMENT

No Federal assistance was used in the development or research of this invention. It is not Federally funded in any way.

REFERENCE TO A MICROFICHE APPENDIX

No computer program or microfiche is required as a part of this invention.

BACKGROUND OF THE INVENTION

A. Field of the Invention

The geared wheelchair ramp is a system that allows a wheelchair 4 and its occupant to ascend and descend horizontal level changes either assisted or unassisted. The invention consists of simple modifications to the wheelchair 4 along with floor or wall mounted guide tracks 2,3 to support and direct the wheelchair 4. The wheelchair 4 is powered by the use of mechanical advantage gained by the use of small drive gears 5 mounted on the wheelchair drive wheels 7. The system is a direct replacement for conventional ramps 1 that requires only a fraction of the space while requiring the same amount of effort to make the level change. There are no motors or electric controls required, and when mounted in a stairway the system does not prevent the use of the stairway.

B. Description of Prior Art

The most common ways for a wheelchair occupant to transit between different horizontal levels are ramps, elevators, and mechanical lifts. Elevators and mechanical lifts use motors and guided cars or platforms to lift the wheelchair between floors. They rely upon an outside power source and are generally custom fabricated for each installation. Problems associated with both elevators and mechanical lifts include expense and lead-time requirements inherent in custom-made apparatus, and complexity of maintenance. The number of moving parts in such systems increases the likelihood of component failure and consequent downtime.

Ramps are simple inclined floor planes with handrails of prescribed height and configuration. The Federal Americans with Disabilities Act regulates the design of such ramps and sets maximum slope at twelve units of run for each unit of rise. The result is that very long ramps are required for only moderate level changes. The costs and space requirements involved are often prohibitive. Therefore, what is needed is a wheelchair lift system that functions like a ramp of accepted proportions, but that requires less space and is less expensive to install. Such a system should allow the wheelchair occupant to transit the level change using no more effort than what is required to use a conventional ramp, either with or without assistance. It must also not block the use of stairs and must be made of simple components which are easy to install in the field and have a minimum of moving parts. The result would be a system with the simplicity of a conventional ramp but that fits into the space of a mechanical lift or elevator.

BRIEF SUMMARY OF THE INVENTION

Figure 1:
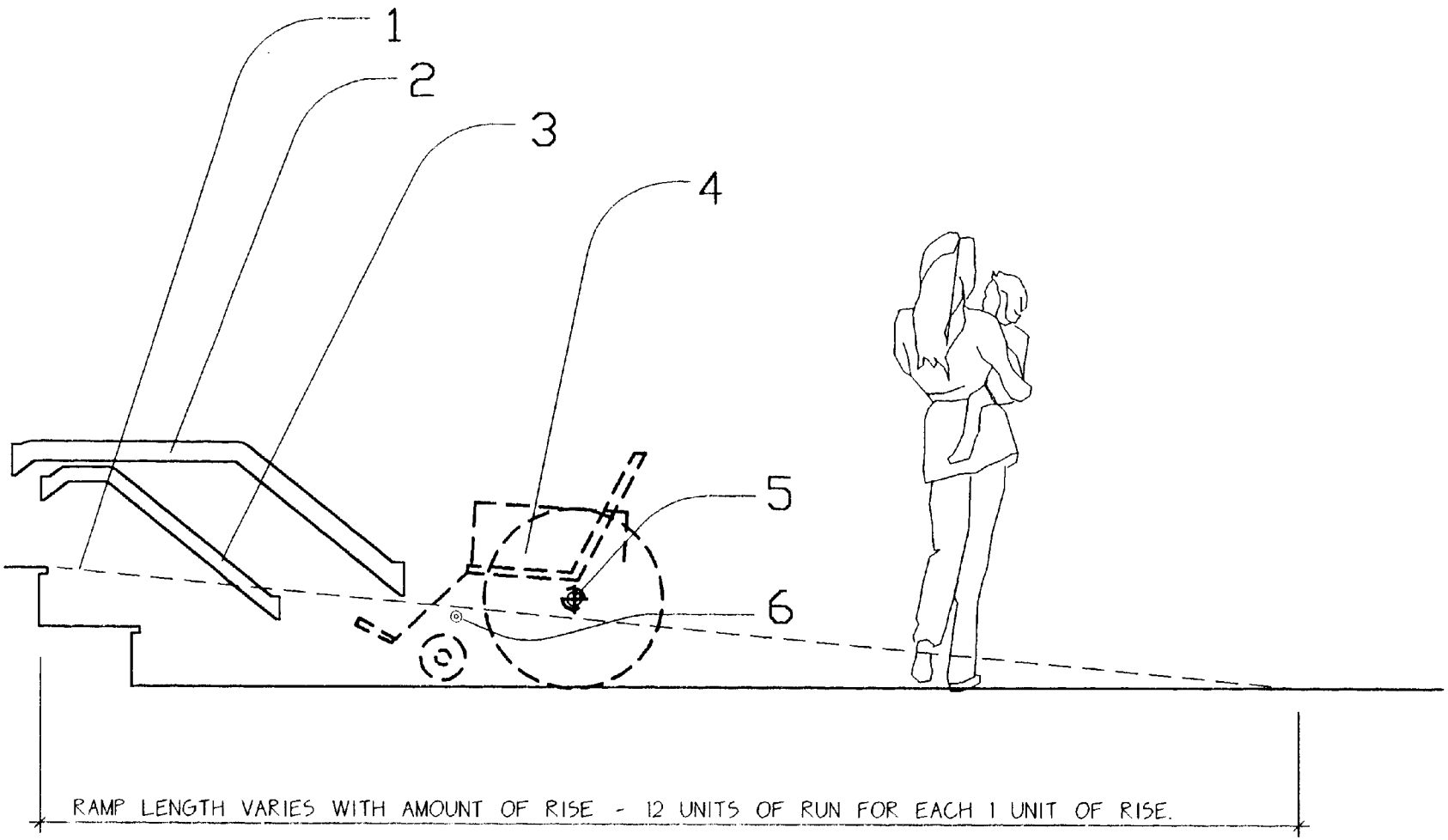
FIG. 1 is an overall general side view of the geared ramp on a typical stairway with the wheelchair midway up the ramp.
Figure 2:
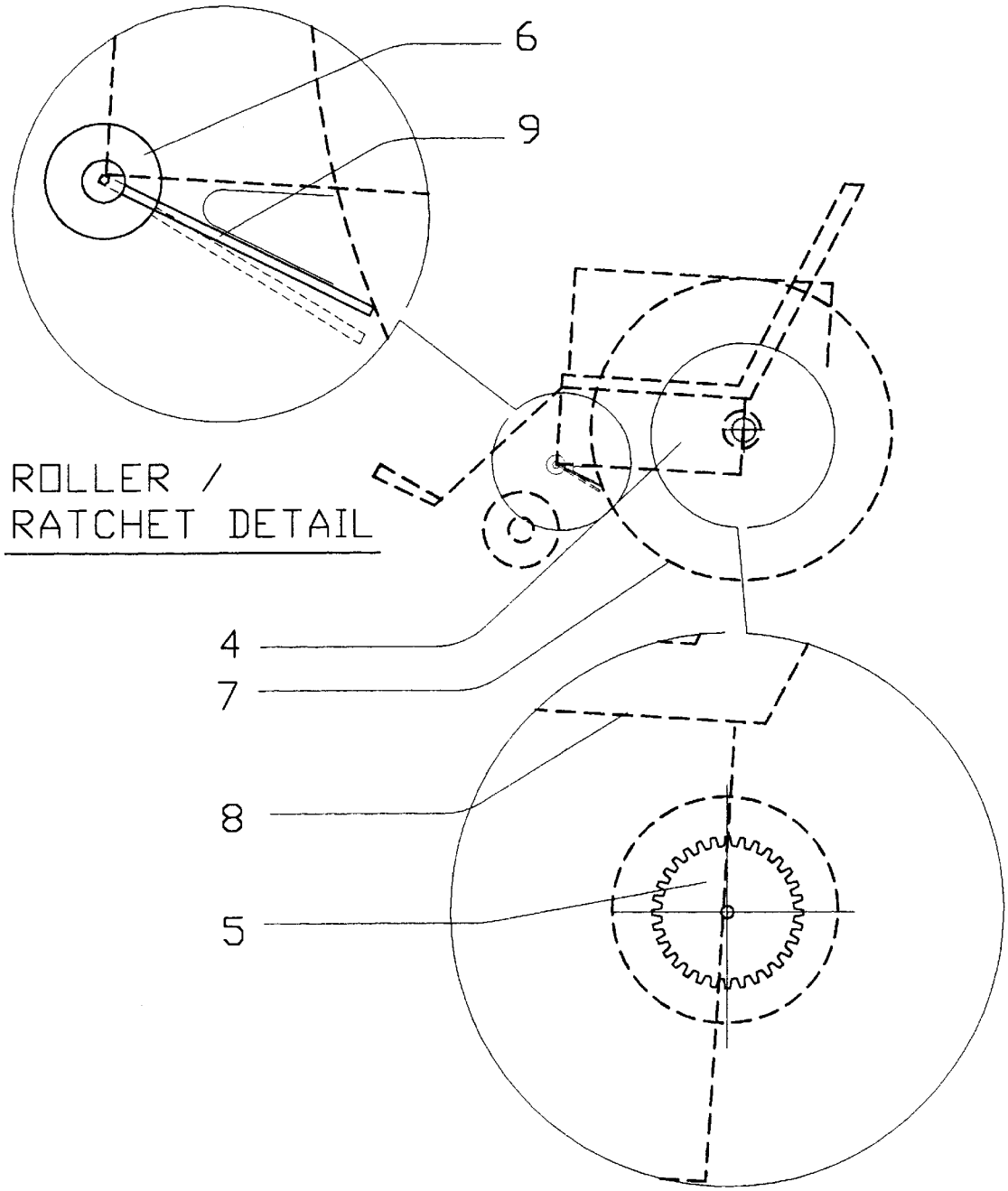
FIG. 2 is a detailed side view of the wheelchair showing the modifications.
Figure 3:
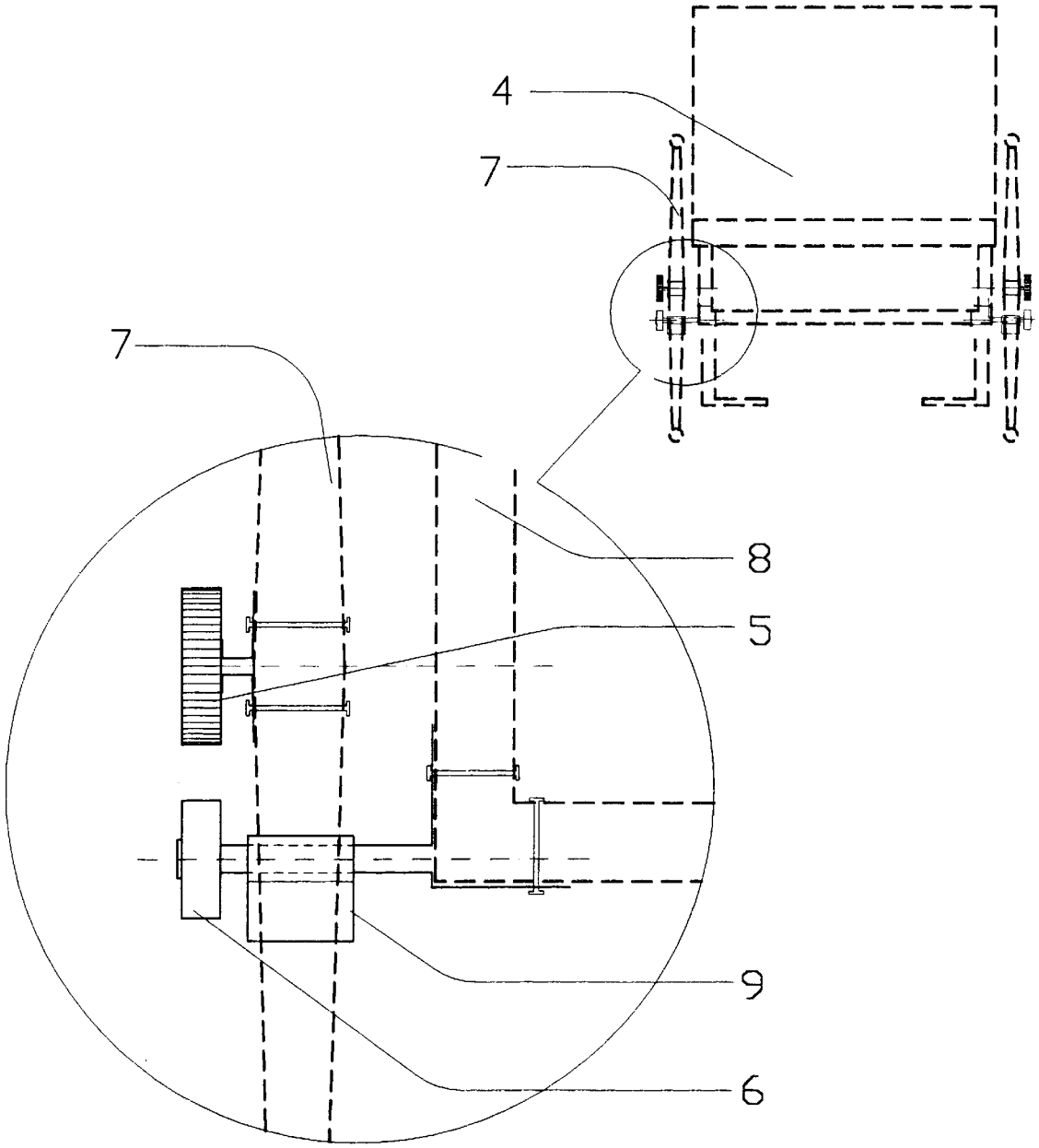
FIG. 3 is a detailed front view of the wheelchair showing the modifications.
Figure 4:
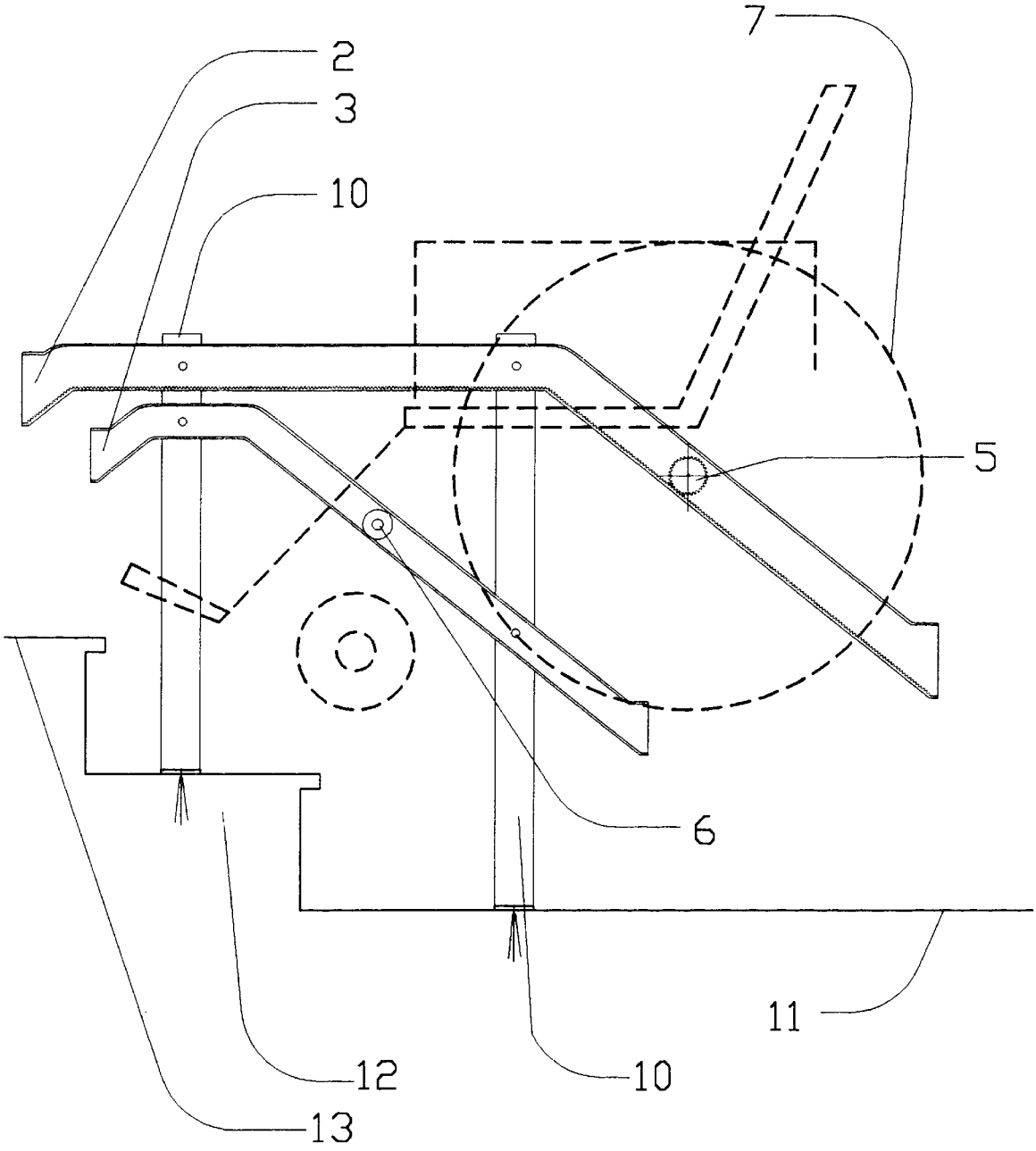
FIG. 4 is a detailed side view of the geared ramp guide track system, including mounting supports.
Figure 5:
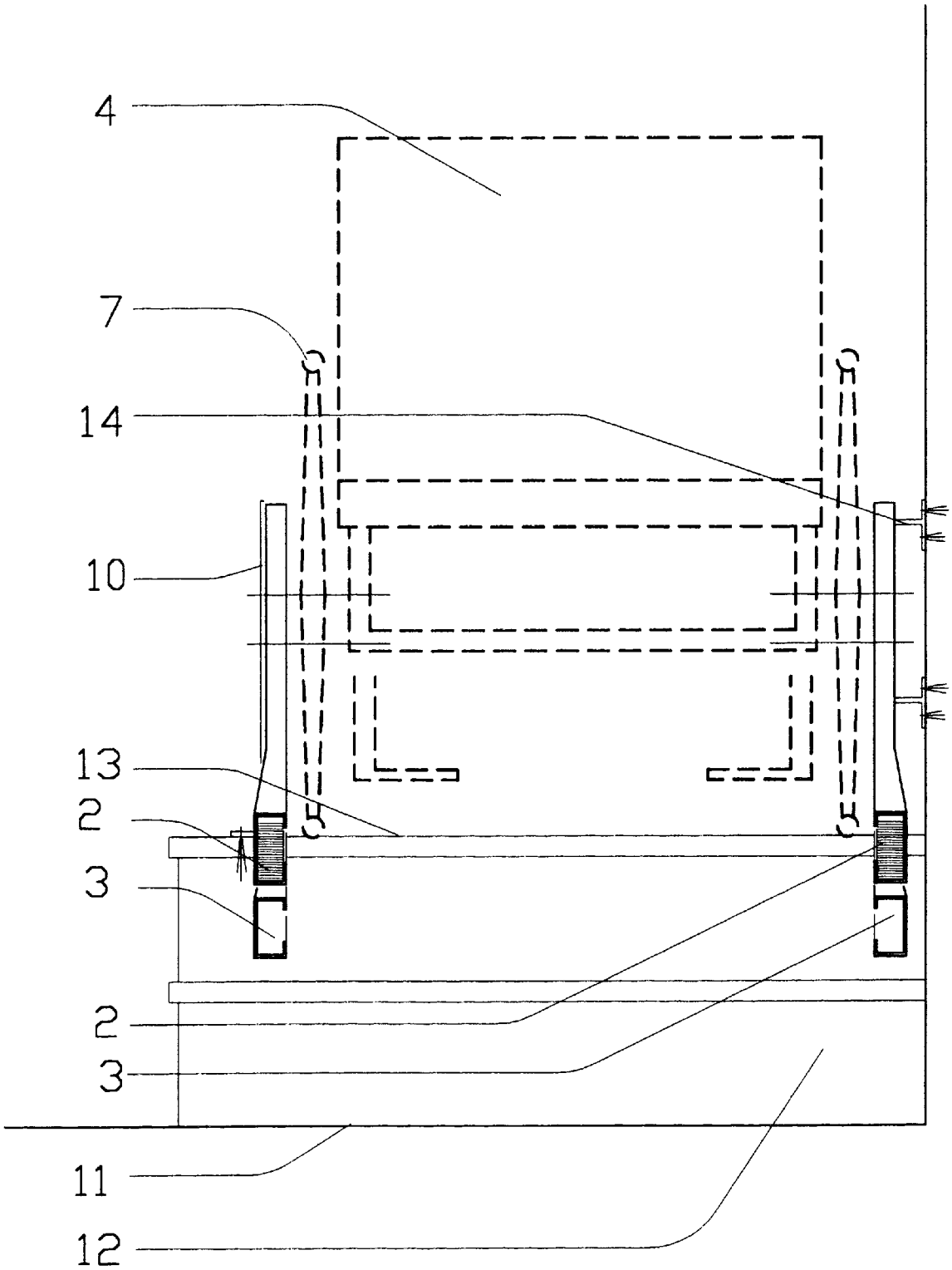
FIG. 5 is a detailed front view of the geared ramp guide track system, including mounting supports.
Figure 6:
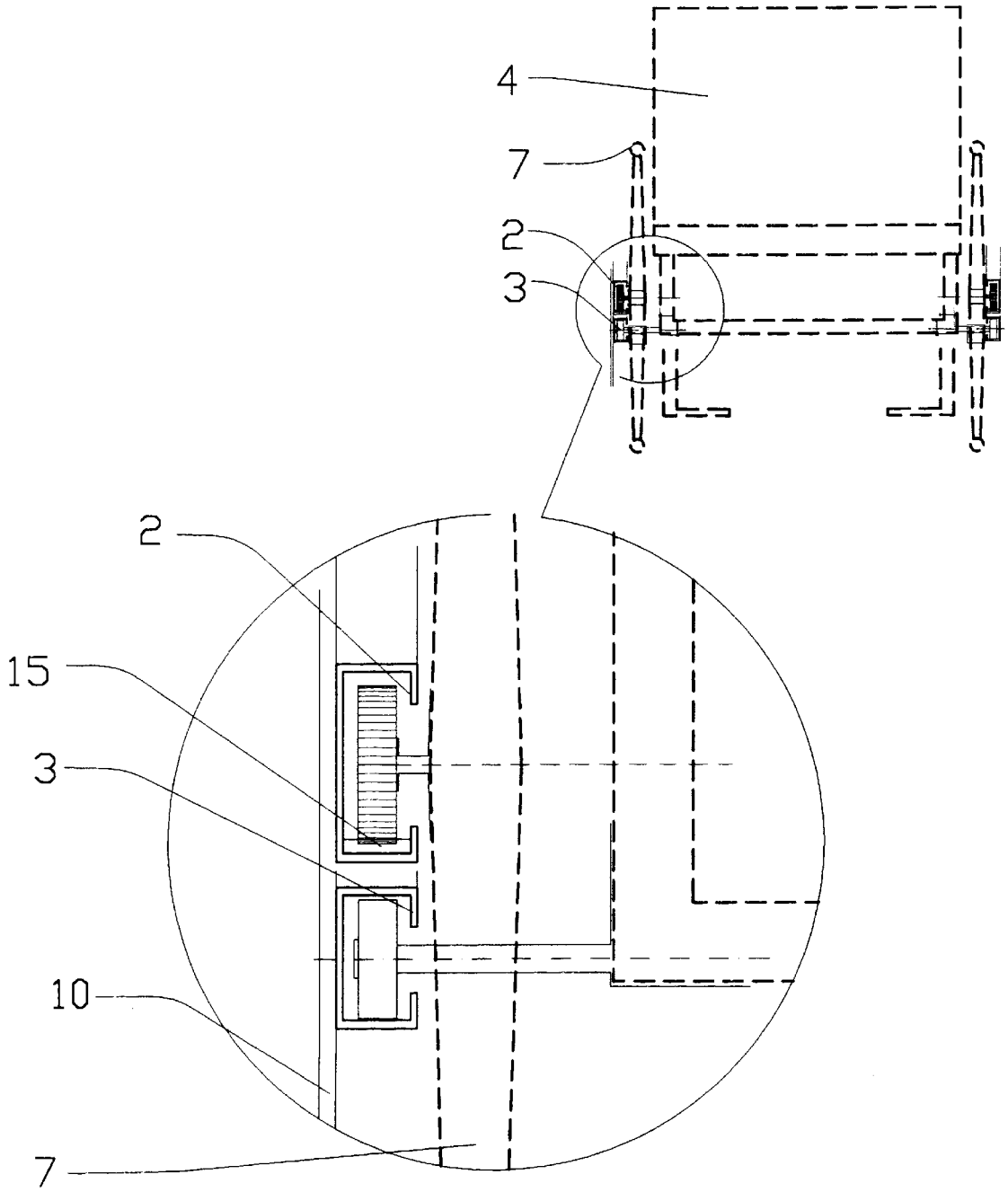
FIG. 6 is a section through the guide rails showing the guide rollers and drive gears.

The geared wheelchair ramp is a direct replacement for conventional ramps intended to allow individuals in wheelchair to go between floor levels. The geared wheelchair ramp achieves this at a small fraction of the space and expense required for a conventional ramp. The geared wheelchair ramp uses a simple gearing principle never before applied to wheelchair transportation. It requires no motors, has few moving parts, and can be mounted on existing stairways without hampering the use of the stairway by others.

DETAILED DESCRIPTION OF THE INVENTION

The geared wheelchair ramp combines small drive gears 5 mounted on the wheelchair drive wheels 7 with geared glide tracks 2 mounted at each side of the wheelchair 4 to provide a lift system. The mechanical advantage is gained by the gear ratio difference of the drive gear 5 and wheelchair drive wheel 7 diameters. The wheelchair 4 is guided by two roller guides 6 mounted on the wheelchair frame 8 and is prevented from rolling backward by ratchet devices 9 mounted with the roller guides 6 which prevent the wheelchair 4 from rolling backward while ascending the geared ramp.

The guide tracks consist of two elements. The geared guide track 2 itself is a "C" shaped track with a geared bottom 15. The roller guide track 3 is also a "C" shaped, but is not geared. The two tracks are configured on each side of the wheelchair 4 in such a way as to guide the wheelchair 4 up or down the elevation change while keeping the seat level. The two tracks 2,3 can be either floor mounted 10 or wall mounted 14 and must be square and evenly spaced. While the slope of the tracks can vary, the slope does effect the gear ratio. For convenience it is best set at a slope of 7 to 11, which is the most common slope for stairways.

The drive gears 5 are mounted on the wheelchair drive wheels 7 and may be made retractable or removable when not in use. The gearing ratio achieved is a function of the diameter of this drive gear 5. At a 1½" in diameter, and mounted on a 24" diameter wheelchair drive wheel 7 the mechanical advantage becomes 16:1. This allows the wheelchair occupant to ascend a geared ramp set at a slope of 7 to 11 using slightly less force than needed for a conventional ramp 1. The number of rotations required to go up the geared ramp is approximately one and one tenth the number required for a conventional ramp. The force required can be changed by altering the diameter of the drive gear. However, as with any gearing system, less force equates to more revolutions. The drive gears 5 ride inside of a "C" shaped geared guide track 2 in such a way that it is impossible for the drive gears 5 to slip or become dislodged from the geared glide track 2 while in use.

The roller guides 6 are mounted onto the wheelchair frame 8 just in front of the main wheelchair drive wheels 7.

They ride inside the "C" shaped roller guide tracks 3 and keep the wheelchair 4 level and square between the tracks. Once the wheelchair 4 has the roller guides 6 and drive gears 5 engaged in the guide tracks 2,3, the wheelchair 4 is fully supported and cannot fall or tip over.

The ratchet devices 9 are simple metal cams mounted onto the roller guides 6 in a fashion that once they are engaged the wheelchair 4 cannot roll backward down the geared ramp. This simplifies ascent by allowing the wheelchair occupant to release the wheelchair drive wheels 7 completely between partial rotations without rolling backwards.

To go from a lower floor level 11 to a higher floor level 13 by means of the geared wheelchair ramp, the user approaches the guide tracks 2,3 straight on and positions his wheelchair 4 between them. The splayed ends of the guide tracks 2,3 allow for some initial misalignment and direct the roller guides 6 and drive gears 5 into the appropriate tracks. The ratchet devices 9 are now engaged and the wheelchair drive wheels 7 rotated a partial turn to engage the drive gears 5 onto the geared guide tracks 2. The wheelchair occupant or an assistant standing behind him now rotates the wheelchair drive wheels 7 and gently rises up the geared ramp. Depending upon the gearing of the system, the effort can be either more than, less than, or exactly equal to the force required to ascend a conventional ramp. Once the wheelchair 4 reaches the top of the geared ramp's incline, it rolls along a level portion and down a slight incline onto the upper level 13. The effort required to propel the chair across the level section and down to the upper level 13 is minimal, being less than required on a level surface. The ratchet devices 9 are then released and the wheelchair 4 is free to go on the upper level 13.

To go from the upper level 13 down to the lower level 11, the wheelchair 4 is positioned between the guide tracks 2,3 in the backward facing position. Again, the flared ends of the guide tracks 2,3 aid in positioning. A partial turn of the wheelchair drive wheels 7 engages the drive gears 5 onto the gear teeth 15 and raises the wheelchair 4 at the bottom of the track up onto the level portion of the guide tracks 2,3. As the wheelchair 4 rolls along the level portion of the guide tracks 2,3 the roller guides 6 are engaged. The wheelchair 4 then rolls down the geared ramp while the occupant applies a slight braking pressure to the drive wheels 7 to control his descent in the same way he does when descending a conventional ramp.

During both the ascent and decent the wheelchair 4 remains level and under complete control. There were no motors or outside power sources required. The system is immune to power failures and most mechanical breakdowns.

In summary, the present invention includes modifications to standard wheelchairs 4 combined with geared tracks 5 and roller tracks 6. Such a design allows access to a different floor level for wheelchair bound persons while still allowing full access to the stairway 12 by others. Furthermore, the system uses only the effort of the wheelchair occupant or an assistant equal to or less than the effort involved in using a conventional ramp. The system can be installed quickly and economically and is a direct substitution for most conventional ramps. The geared wheelchair ramp has direct applications for:

Home use, where space is at a premium and the individual has his own wheelchair.

In vans, where the guide rails can be mounted on a pivot to hinge out when the van doors open.

Swimming pools, where electric devices are dangerous and a special waterproof chair can be provided.

Public outdoor locations where ramps are not practical and modified chairs can be provided for public use.

Historic buildings where ramps are not desirable and modified chairs can be provided for public use.

The geared wheelchair ramp works well for rises from one to five feet. Less than that and a conventional ramp is more practical. More than that and it becomes too tiring for the wheelchair occupant. The amount of space required at the top and bottom of the stairs remains constant for all amounts of rise greatly reducing the space requirements associated with conventional ramps.

What is claimed is:

1. A system for conveying a wheelchair and an occupant of the wheelchair between horizontal floor levels, comprising:

drive gears mounted directly onto drive wheels of the wheelchair;

one or more roller guides mounted directly onto a frame of the wheelchair;

ratchet devices mounted directly onto the frame of the wheelchair and operative to engage the drive wheels of the wheelchair and prevent the wheelchair from rolling backwards;

wall or floor mounted geared guide tracks to engage the drive gears and configured to support the wheelchair and allow the wheelchair to transit between levels;

wall or floor mounted roller guide tracks configured to engage the roller guides and maintain the wheelchair in a level position while in transit between levels.

2. A method of conveying an occupied wheelchair between two horizontal levels, said method comprising the steps of:

equipping the wheelchair with drive gears, roller guides, and ratchet devices;

placing the occupied wheelchair in a geared ramp system between geared guide tracks configured to engage the drive gears and roller guide tracks configured to engage the roller guides;

engaging the drive gears of the wheelchair onto the geared guide tracks;

engaging the roller guides into the roller guide tracks;

rotating drive wheels of the wheelchair to transit between levels using an amount of effort equal to an amount of effort normally required to use a conventional ramp; and exiting the geared ramp system.

* * * * *